US005564153A

United States Patent [19]

Lange

[11] Patent Number: 5,564,153

[45] Date of Patent: Oct. 15, 1996

[54] BRUSH ELEMENT FOR HAIR CARE

[75] Inventor: Klaus-Peter Lange, Eppstein, Germany

[73] Assignee: Braun Aktiengesellschaft, Frankfurt, Germany

[21] Appl. No.: 295,825

[22] PCT Filed: Nov. 9, 1993

[86] PCT No.: PCT/EP93/03134

§ 371 Date: Sep. 12, 1994

§ 102(e) Date: Sep. 12, 1994

[87] PCT Pub. No.: WO94/15497

PCT Pub. Date: Jul. 21, 1994

[30] Foreign Application Priority Data

Jan. 13, 1993 [DE] Germany ..... 43 00 687.6

[51] Int. Cl.[6] ..... A46B 1/00; A46B 9/02

[52] U.S. Cl. ..... 15/187; 15/186; 15/207.2; 132/271

[58] Field of Search ..... 15/186, 187, 188, 15/195, 205, 207.2; 132/120, 137, 138, 157, 160, 313, 271; D4/130, 132, 133, 134, 136

[56] References Cited

U.S. PATENT DOCUMENTS

| | | | |
|---|---|---|---|
| D. 253,322 | 11/1979 | Saute | D4/136 |
| 871,121 | 11/1907 | D'Humy | 15/188 |
| 2,915,767 | 12/1959 | Vaughan | 15/186 |
| 3,087,223 | 4/1963 | Raw | 132/313 |
| 4,493,126 | 1/1985 | Uy | 15/186 |
| 4,504,998 | 3/1985 | Price | 132/313 |

FOREIGN PATENT DOCUMENTS

| | | | |
|---|---|---|---|
| 0103205 | 3/1984 | European Pat. Off. . | |
| 2248806 | 5/1975 | France . | |
| 2508951 | 9/1976 | Germany . | |
| 238798 | 8/1925 | United Kingdom | 15/186 |
| 254631 | 7/1926 | United Kingdom | 15/188 |
| 2195882 | 4/1988 | United Kingdom . | |

OTHER PUBLICATIONS

PCT Search Report–PCT/EP93/03134.

*Primary Examiner*—David Scherbel
*Assistant Examiner*—Randall E. Chin
*Attorney, Agent, or Firm*—Edward S. Podszus

[57] ABSTRACT

The invention is directed to a brush element (10) for hair care, in particular for a heat-emitting and/or air-moving hair care appliance, comprising a body (12) and a plurality of bristles (14 to 25) arranged on the body (12) at an angle of inclination (a) to a surface normal (38) of the brush element (10). The angle of inclination of the bristles (14 to 25) to the surface normal (38) is between 15° and 75°, and the bristles (14 to 25) are arranged in a row (26, 28, 30, 32, 34, 36) extending in the direction of a brush element longitudinal axis (13), with adjacent bristles (14, 15, 16, 17; 18, 19, 20, 21; 22, 23, 24, 25) of a row (26, 28, 30, 32, 34, 36) forming V-shaped bristle pairs (37).

20 Claims, 8 Drawing Sheets

BRUSH ELEMENT FOR HAIR CARE

BACKGROUND OF THE INVENTION

This invention relates to a brush element for hair care, in particular for a heat-emitting and/or air-moving hair care appliance, comprising a body and a plurality of bristles arranged on the body at an angle of inclination to a surface normal of the brush element.

PRIOR ART

A brush element for hair care of this type is already known from applicant's printed specification EP 0 103 205 A1. In this specification, the bristles are arranged on several parallel rib members at varying angles of inclination to a surface normal. Two bristles combine to form an integral part located at the root of the bristles, causing a slight offset of the two bristles resulting in a somewhat slanting position. This brush element is intended to find useful application in combing hair, the slight slanting position of the bristles being intended to improve guiding of the hair, while the offset of the bristles is to enable a greater amount of hair to be picked up.

Printed specification DE 25 08 951 A1 discloses a brush element for a hot-air hair care and hair styling appliance comprising comb teeth or bristles protruding from the body at an angle of inclination to the surface normal of the body. Blasts of hot air discharged through nozzles in the body are directed to the bristles at right angles or at an angle deviating from the angle of inclination of the bristles, in order to provide for improved drying of the hair, in particular the lower hair layers.

SUMMARY OF THE INVENTION

By contrast, it is an object of the present invention to improve upon a brush element incorporating the features initially referred to in such a manner that hair of any density, thickness, form and length can be subjected to an increased pulling action as it is combed, and that the hair pick-up action can be improved. This object is essentially accomplished in that the angle of inclination of the bristles to the surface normal is between 15° and 75°, and that the bristles are arranged in a row extending in the direction of a brush element longitudinal axis, with adjacent bristles of a row forming V-shaped bristle pairs. This bristle arrangement enables the hair to be grasped effectively and to be guided in the direction of the body, that is, towards the root of the bristles, whereby a pulling action is exerted on the hair resulting particularly in an effective smoothing of the hair. Due to the hair being directed down to the root of the bristles, a good heat transfer to the hair is accomplished in cases where heat-emitting hair care appliances are used, while in air-moving hair care appliances an undesired upsetting of the hair by the air stream is avoided. By giving the brush element a turning or tilting motion, the picked up hair can be lifted for thorough drying in the region of the scalp, in addition to building in volume. The inclination of the bristles preferably made from a flexible material provides a spring effect conveying a pleasant feeling to the user's scalp during combing and effecting a massage beneficial to the circulation of blood in the scalp.

Advantageously, several rows of bristles are arranged on the body, enabling a larger section of hair to be picked up as a result of which the time the user spends on hair care can be reduced, improving at the same time the massage effect.

By combining at least two rows to form a pair of rows and by arranging adjacent bristles of a pair of rows in relative parallel orientation, hair is received readily in the space between the bristles, and the guiding of individual strands of hair to the bristle root is improved.

In an advantageous further feature of the present invention, the bristles of a pair of rows are arranged on the body so their forward ends are oriented towards and away from each other alternately. As a result of this arrangement, the bristles oriented towards each other cause the hair to be directed towards the root of the bristles as it is combed, drawing it over the body between the bristles, whereby a smoothing effect occurs.

Advantageously, the bristles of a pair of rows are in parallel arrangement on the body along a line on the body extending normal to the brush element longitudinal axis. As a result, the strands of hair are directed in a straight-line motion towards and over the root of the bristles, the hair being smoothed as a pull is exerted.

In a still further feature of the present invention, the bristles of a pair of rows are arranged in an offset orientation to each other. As a result, the hair is guided between and along the bristles in wave shape, enabling the pulling action of the bristles upon the hair to be augmented.

By spacing the rows of a pair of rows at such a relative distance that, in a projection onto a plane constructed normal to the brush surface, the bristles intersect in a region, an extremely advantageous arrangement results, favorably affecting the guiding of hair towards the bristle root as well as the pick-up of hair by the brush element.

In an advantageous further feature of the present invention, the bristles of adjacent pairs of rows are arranged on the body so as to be inclined in opposite direction relative to the surface normal. This opposed inclination of adjacent pairs of rows makes it possible to control the pulling action to the effect that the pull exerted on, for example, very thick or very curly hair can be reduced, enabling the hair to be smoothed in a preliminary operation.

Because the pairs of rows are arranged on strips attached to the body by a wedging or welding operation, a secure location of the strips affording ease of manufacture is made possible.

Advantageously, the bristles of each row are configured as an integrally formed bristle strip. This is beneficial from the manufacturing point of view, enabling the bristle strips to be fabricated as injection-molded parts fitted to the body as a unit.

In a particularly advantageous feature of the present invention, the body is of a concave configuration, resulting in an increase in the number of bristles penetrating the hair at a time and enabling the pulling action to be augmented still further because of the denser interengagement of the bristles of individual pairs of rows. This enhanced pulling action provides at the same time an improved hair smoothing effect.

By providing apertures in the body for receiving the bristles, with adjacent apertures of a row being at approximately right angles to each other, it is possible to securely locate the bristles in the body, and a uniform V-shaped arrangement of adjacent bristles of all rows and pairs of rows of the brush element is aided.

Further objects, features, advantages and application possibilities of the present invention will become apparent from the subsequent description of embodiments. It will be understood that all features described and/or represented by illustration, whether taken alone or in any desired combination, constitute the subject-matter of the present invention, irrespective of their summarization in the claims or their back-references.

DETAILED DESCRIPTION OF THE INVENTION

Figure 1:
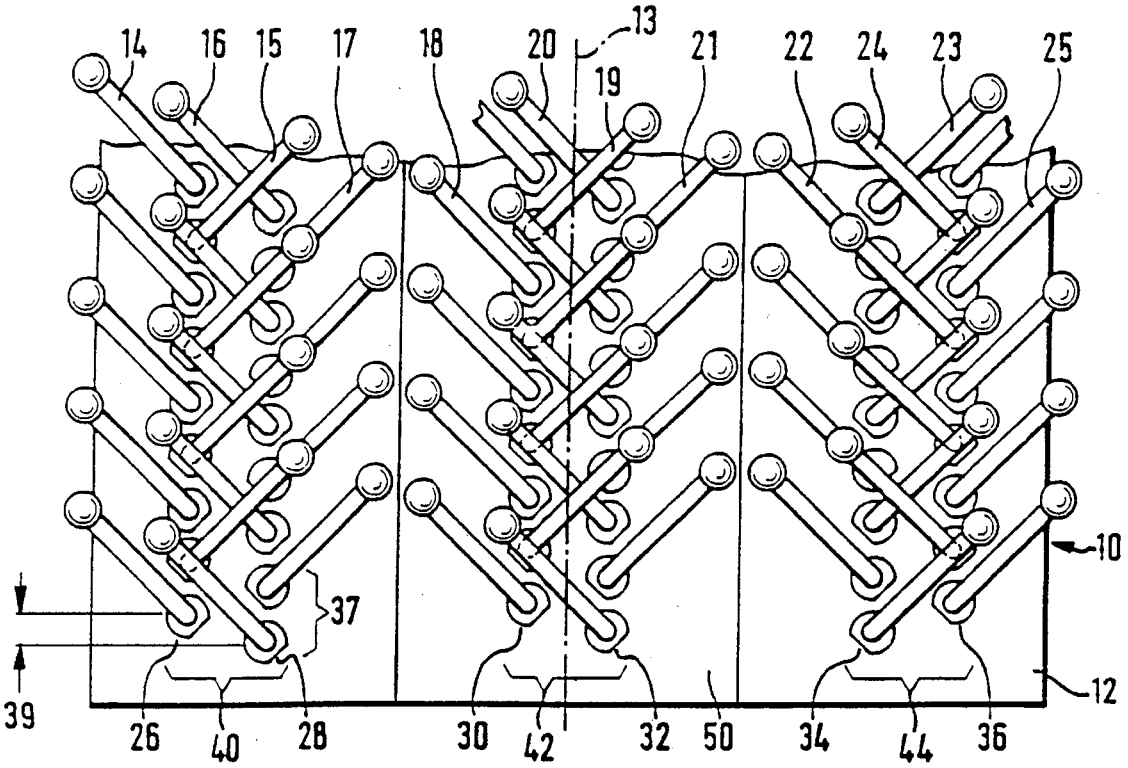
FIG. 1 is a top plan view of a brush element according to a first embodiment of the present invention, showing an enlarged detail.
Figure 8:
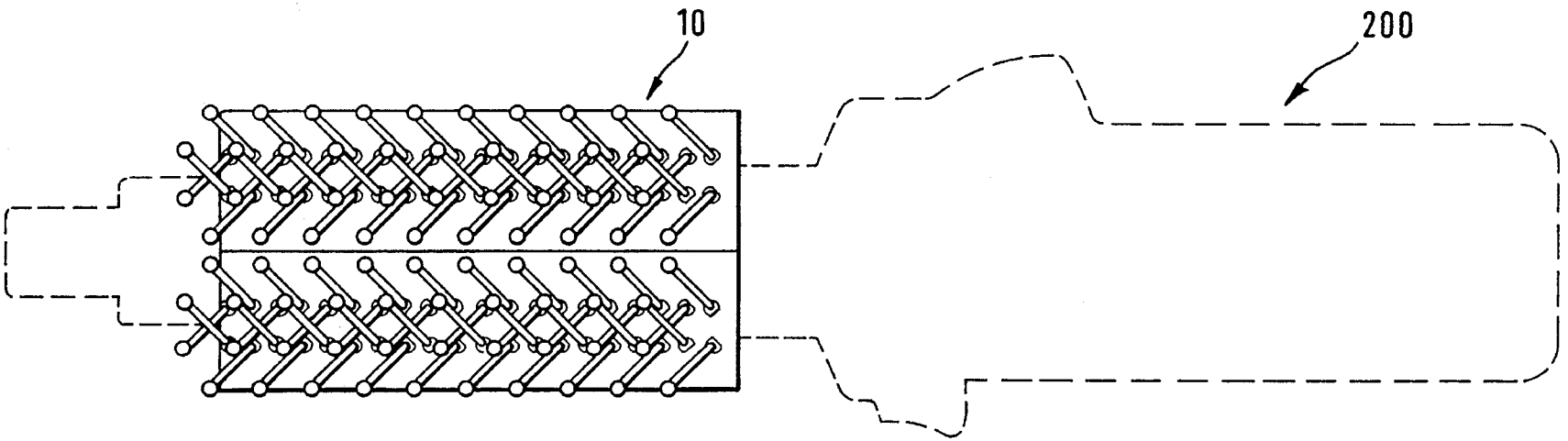
FIG. 8 is a plan elevational view of a brush element attached to a heat-emitting hair care appliance 200 shown in phantom.
Figure 9:
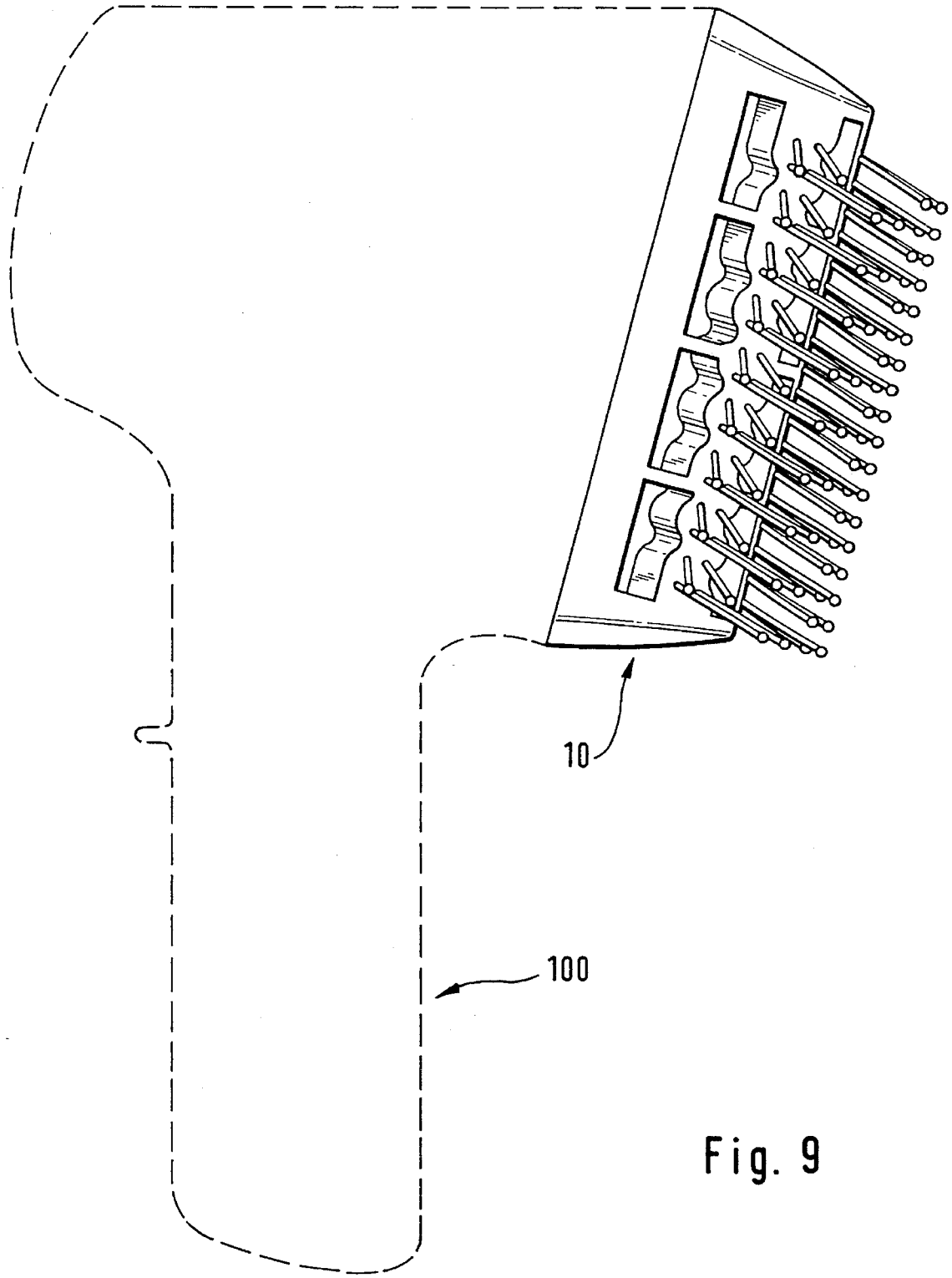
FIG. 9 is a side elevational view of a brush element attached to an air-moving hair care appliance 100 shown in phantom.

FIG. 1 shows a first embodiment of a brush element 10. Bristles 14 to 25 are arranged on the body 12 in rows 26, 28, 30, 32, 34, 36, two rows 26, 28; 30, 32 and 34, 36 combining to form respective pairs of rows 40, 42, 44. The pairs of rows 40, 42 and 44 are disposed in strips 50, which may be exchanged if necessary, or which are secured to the body 12 by a wedging or welding operation. The adjacent bristles 14, 16; 15, 17; 18, 20; 19, 21; 22, 24; 23, 25 of adjacent rows 26, 28; 30, 32; 34, 36 are in parallel orientation to each other, with the rows 26, 28, 30, 32 and 34, 36 being arranged in offset relation 39 to each other in respect of a brush element longitudinal axis 13. In a second construction variant shown in FIG. 2A of the first embodiment, the adjacent bristles 14, 16; 15, 17; 18, 20; 19, 21; 22, 24; 23, 25 of adjacent rows 26, 28; 30, 32; 34, 36 are arranged in the body 12 in parallel orientation to each other as well as in parallel arrangement along a line extending normal to the brush element longitudinal axis 13. In this embodiment, the body 12 may be of a plane or convex configuration. Two bristles each 14, 15; 16, 17; 18, 19; 20, 21; 22, 23; 24, 25 of a row 26, 28, 30, 32, 34, 36 combine to form a V-shaped pair of bristles 37. During combing of the hair, hair enters the space between the bristles 14 to 25 of rows 26, 28, 30, 32, 34, 36 in strands which are then directed to the root of the bristles, that is, to the body 12, and drawn over the body surface, the bristle arrangement producing a pulling action on the hair, smoothing it. By applying pressure to the scalp, the pulling action on the hair can be further augmented. Equally, the user may exert a greater or lesser pull on the hair by combing in the direction of, or in opposition to, the bristle orientation. By tilting or turning the brush element 10 when attached to or on a heat-emitting (see FIG. 8) and/or air-moving (see FIG. 9) hair care appliance, the hair is lifted and dried at the root, giving the hair more body and fullness.

Figure 2:
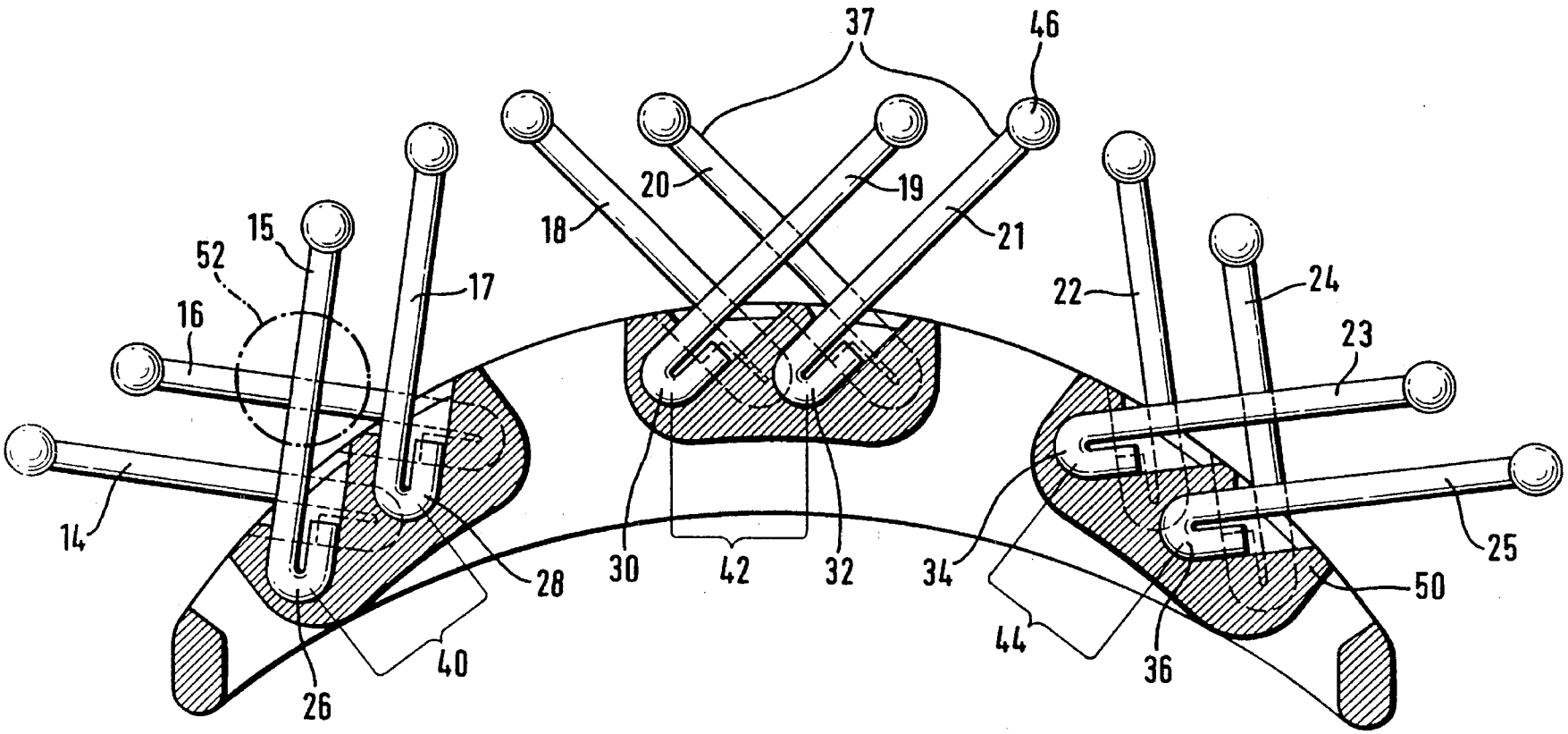
FIG. 2 is an enlarged partial sectional view along line 2—2 of FIG. 2A of a brush element according to the second construction variant of the first embodiment of the present invention.
Figure 2A:
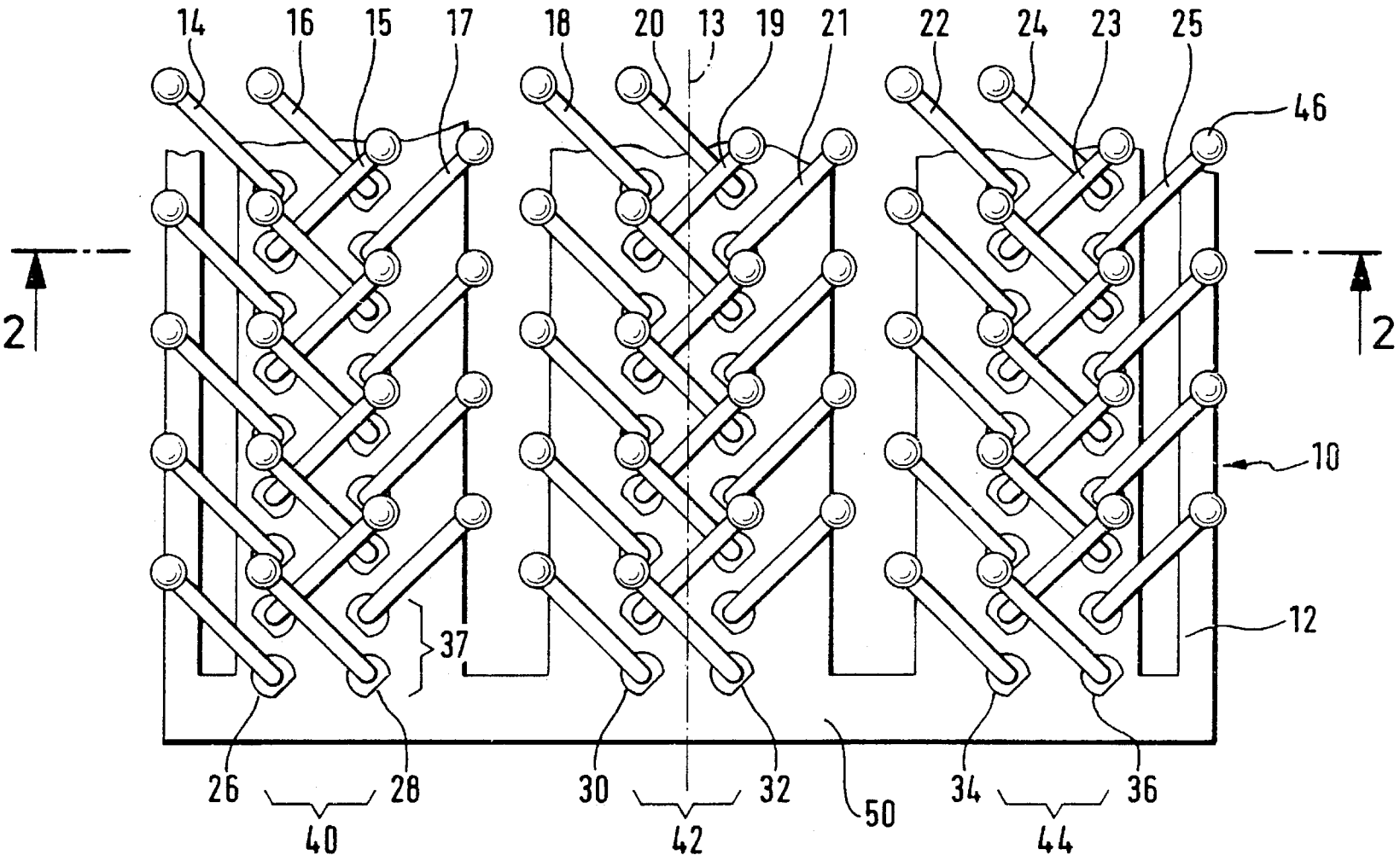
FIG. 2A is a top plan view of a brush element according to a second construction variant of the first embodiment, showing an enlarged detail thereof.
Figure 2B:
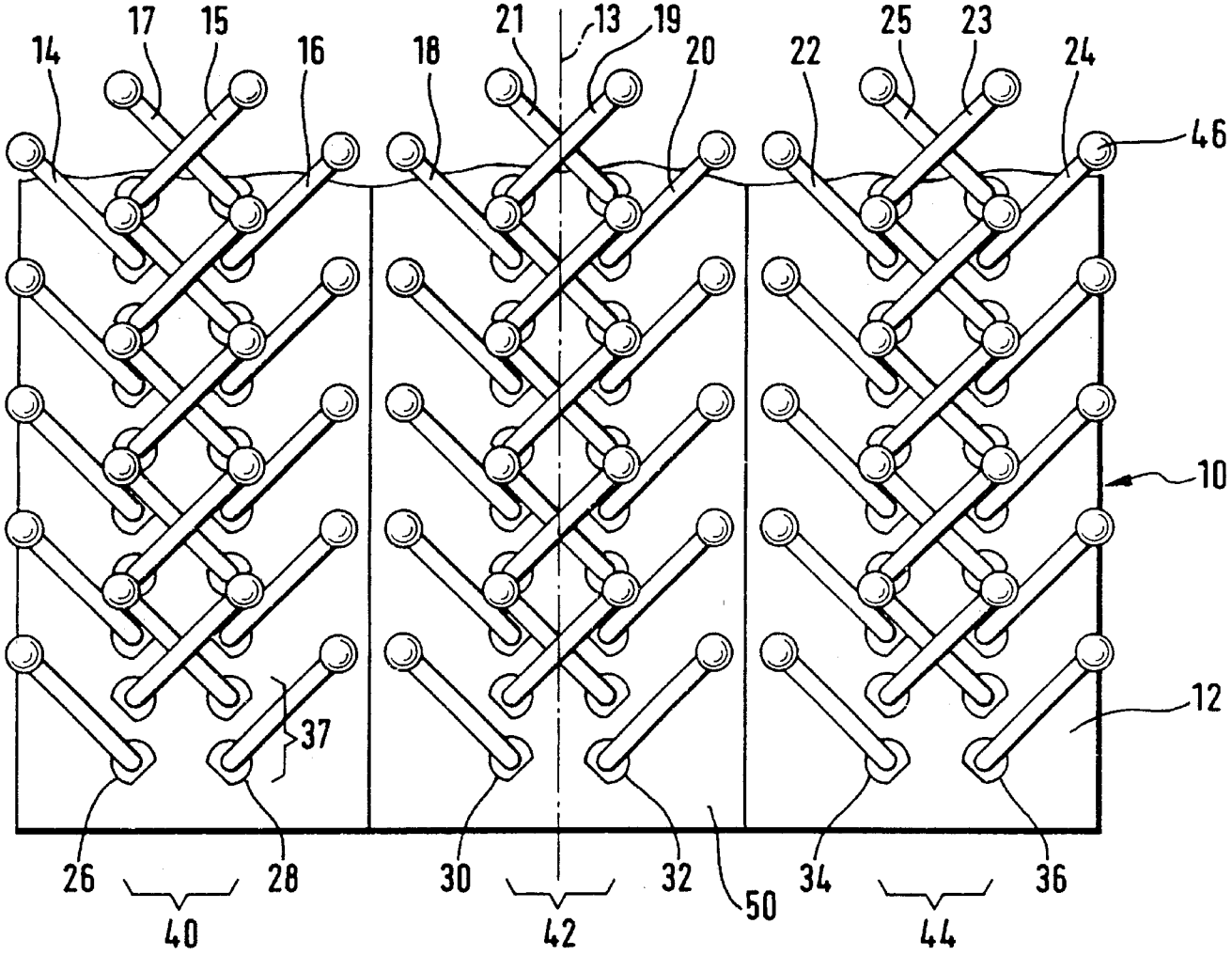
FIG. 2B is a top plan view of a brush element according to a third construction variant of the first embodiment, showing an enlarged detail thereof.
Figure 7:
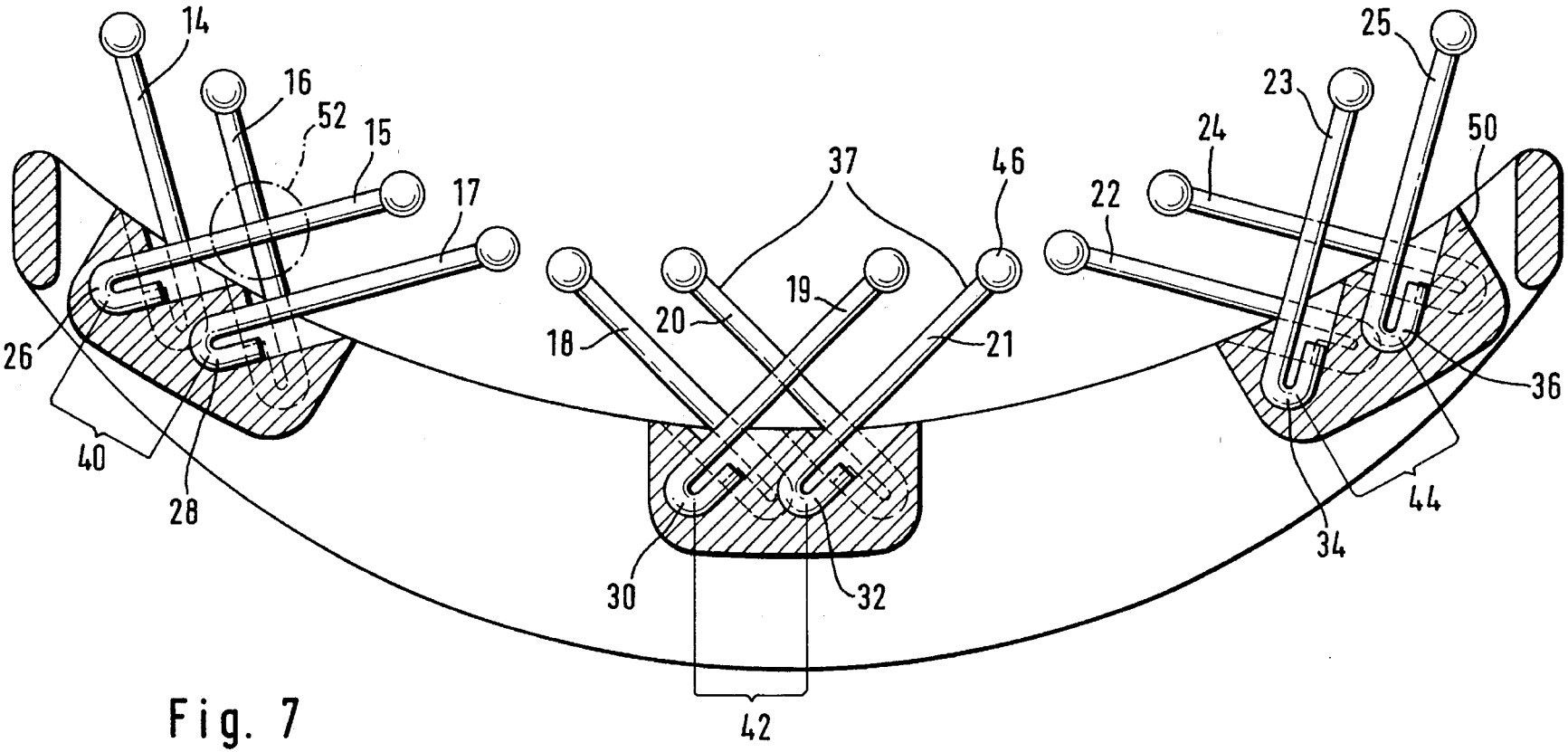
FIG. 7 is a partial sectional view of another construction variant of the brush element of FIG. 2.

A sectional view of a brush element 10 as shown in FIG. 2 illustrates the special arrangement of the bristles 14 to 25 in the body 12. The bristles 14 to 17, 18 to 21, and 22 to 25 of adjacent rows 26, 28; 30, 32; 34, 36 form respective pairs of rows 40, 42, 44, with the bristles 14, 16; 15, 17; 18, 20; 19, 21; 22, 24; 23, 25 being arranged parallel to each other. As illustrated in FIG. 2A and FIG. 2, the adjacent bristles 14, 15; 16, 17; 18, 19; 20, 21; 22, 23; 24, 25 of each row 26, 28, 30, 32, 34, 36 alternately extend to the left and right, thereby forming a V-shaped pair of bristles 37. In this arrangement, the bristle pairs 37 formed by the respective bristles 14, 15; 16, 17; 18, 19; 20, 21; 22, 23; 24, 25 enclose an approximately right angle. The relative distance of the rows 26, 28, 30, 32, 34, 36 is selected such that the bristles 15, 16; 19, 20; 23, 24 intersect in a region 52. Each pair of rows 40, 42, 44 is disposed in a strip 50. The bristles 14, 16; 15, 17; 18, 20; 19, 21; 22, 24; 23, 25 of all pairs of rows 40, 42, 44 may be arranged parallel to each other, with their forward ends 46 extending in the same direction as illustrated in FIG. 2A or, as illustrated in FIG. 2B, they may have their forward ends 46 extend alternately towards and away from each other for each pair of rows 40, 42, 44. The body 12 is convex, that is, outwardly domed. In a further embodiment as shown in FIG. 7, the body may equally well be concave, that is, inwardly domed, the bristles 14 to 25 of the pairs of rows 40, 42, 44 then interengaging more densely, thereby exerting an increased pulling action on the hair.

Figure 3:
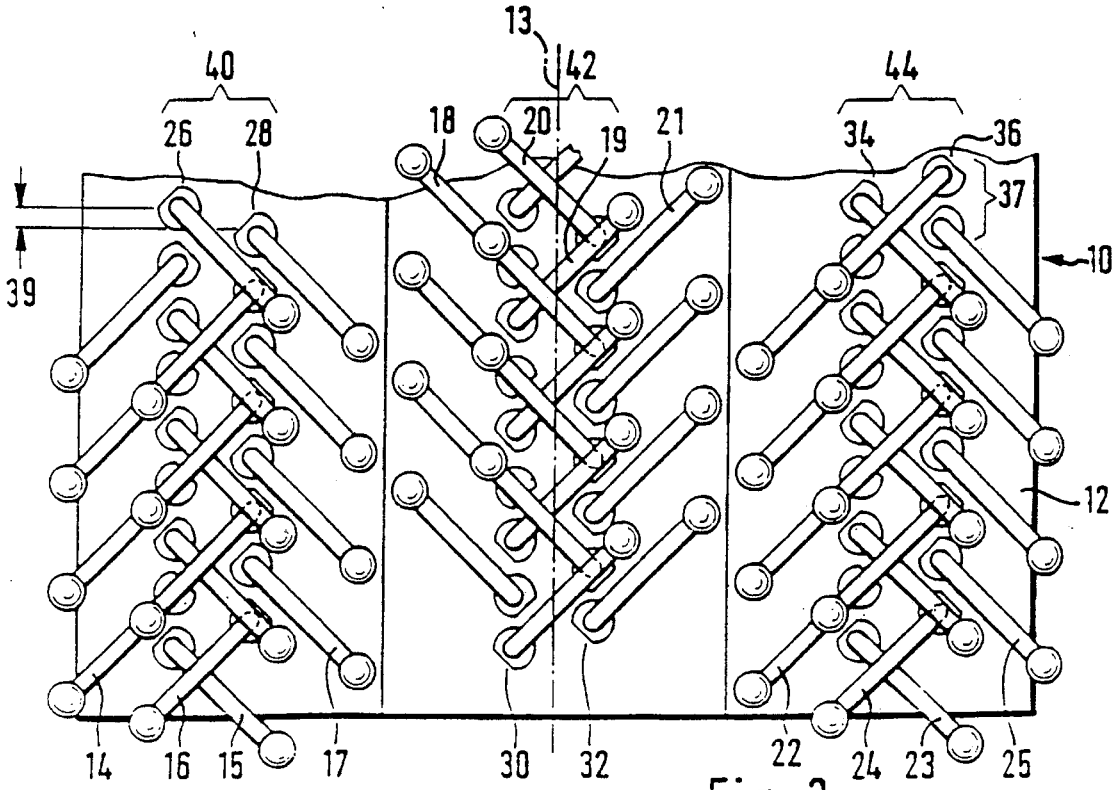
FIG. 3 is a top plan view of a brush element according to a second embodiment of the present invention, showing an enlarged detail.
Figure 4:
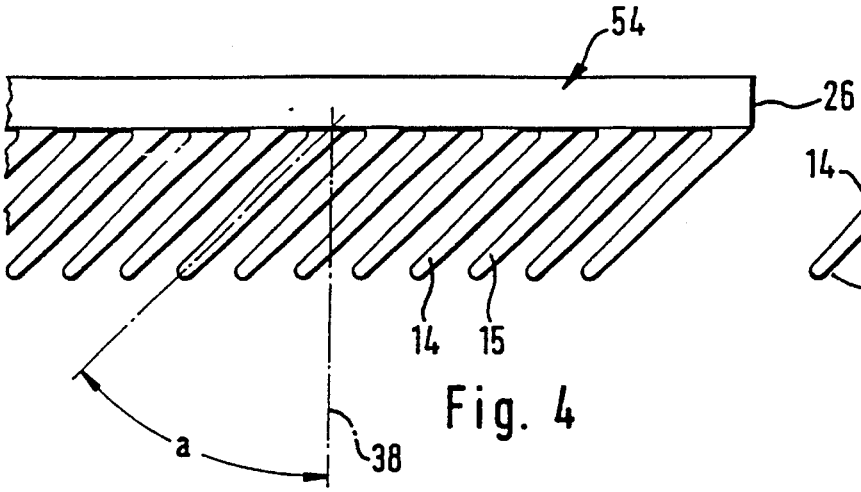
FIG. 4 is a side view of a bristle strip showing an enlarged detail.

In FIG. 3, the bristles 14 to 17, 18 to 21, and 22 to 25 of adjacent pairs of rows 40, 42, 44, respectively are arranged on the body 12 of the brush element 10 so as to be inclined at an angle of inclination "a" in relative opposite directions to a surface normal 38 shown by example in FIG. 4. The adjacent bristles 14, 16; 15, 17; 18, 20; 19, 21; 22, 24; 23, 25 of adjacent rows 26, 28; 30, 32; 34, 36, respectively are maintained in parallel orientation to each other, in addition to being arranged in offset relation 39 to each other in respect of the brush element longitudinal axis 13, with the bristles 15, 16; 19, 20; 23, 24 intersecting in a region 52. In a second construction variant of the embodiment shown in FIG. 3, the adjacent bristles 14, 16; 15, 17; 18, 20; 19, 21; 22, 24; 23, 25 of adjacent rows 26, 28; 30, 32; 34, 36 may be arranged in the body 12 parallel to each other as well as along a line extending normal to the brush element longitudinal axis 13.

FIG. 4 shows the bristles 14, 15 of row 26 as an integrally formed bristle strip 54. In this configuration, the arrangement of the bristles 14 to 25 on the respective bristle strips 54 as, for example, the angle of inclination "a" to the surface normal 38, as well as the arrangement of adjacent strips 54 are analogous to the embodiments described in the foregoing. The bristle strips 54 are preferably injection-molded parts which are assembled with the body 12 as a unit either singly or in pairs in the desired quantity. The bristle strips 54 are secured to the body by a wedging or welding operation.

Figure 5:
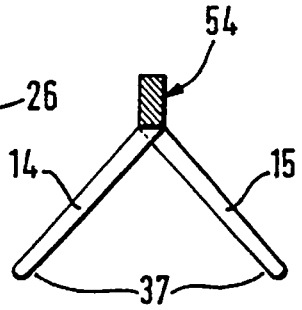
FIG. 5 is a sectional view of the bristle strip of FIG. 4.

FIG. 5 shows one of the bristle strips 54 with a V-shaped pair of bristles 37 comprised of the bristles 14 and 15. In this arrangement, the bristles 14, 15 enclose an approximately right angle which is, however, variable depending on the embodiment of the brush element 10.

Figure 6:
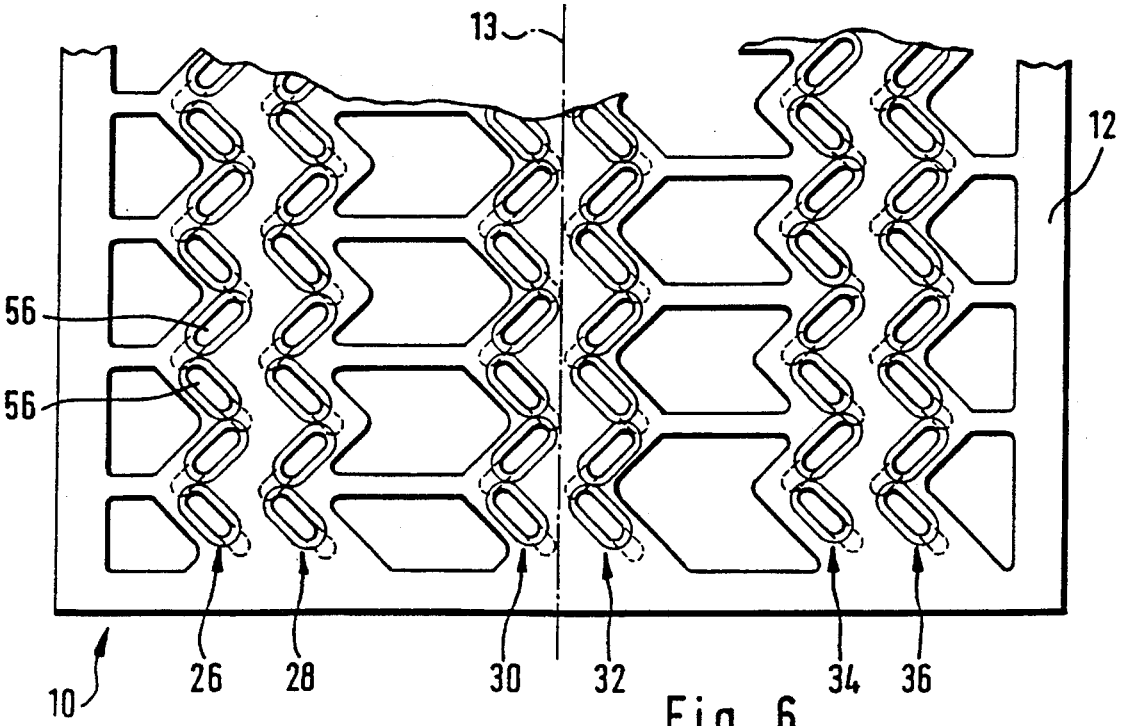
FIG. 6 is a top plan view of a body of a brush element showing an enlarged detail.

According to FIG. 6, the body 12 of a brush element 10 includes a plurality of apertures 56 for receiving the bristles 14 to 25. In this configuration, the apertures 56 are arranged such that adjacent apertures 56 of a row 26, 28, 30, 32, 34, 36 are at approximately right angles to each other. The apertures 56 of adjacent rows 26, 28; 30, 32; 34, 36 are parallel to each other and arranged in the body 12 along a line extending normal to the brush element longitudinal axis 13. In the embodiment of FIG. 1, the apertures 56 of adjacent rows 26, 28; 30, 32; 34, 36 are arranged in offset relation 39 to each other in respect of the brush element longitudinal axis 13.

I claim:

1. A brush element (10) for styling hair, said element comprising a body having a body surface and a first axis (13); and a plurality of bristles each having a root end and a forward end, the plurality of bristles being disposed on the body with the root end proximate to the body surface, the bristles being arranged on the body at an angle of inclination (a) to a surface normal (38) of the body surface, wherein the angle of inclination is between 15° and 75°, wherein the bristles are arranged in a first row and an adjacent second row, each said row extending substantially parallel to the first axis (13), with adjacent bristles of each said row forming at least three V-shaped bristle pairs (37) and wherein the first and second rows are disposed on the body surface such that a projection of the V-shaped bristle pairs of the first row onto an imaginary plane constructed normal to the body surface and perpendicular to the first axis (13) intersects a projection onto said imaginary plane of the V-shaped bristle pairs of the second row.

2. The brush element as claimed in claim 1, wherein the bristles are arranged on the body in at least three pairs of adjacent first and second rows.

3. The brush element as claimed in claim 1 or claim 2, wherein the bristles of the first row are arranged in substantial parallel orientation relative to the bristles of the second row that are adjacent the bristles of the first row.

4. The brush element as claimed in claim 1 or claim 2, wherein the forward ends of the bristles of the first row are arranged on the body oriented alternately towards and away from the forward ends of the bristles of the second row that are adjacent the bristles of the first row.

5. The brush element as claimed in claim 1 or claim 2, wherein the roots of the bristles of the first row and the roots of the bristles of the second row that are adjacent the bristles of the first row are arranged on the body along a line along the body surface extending normal to the body first axis (13).

6. The brush element as claimed in claim 1 or claim 2, wherein the roots of the bristles of the first row and the roots of the bristles of the second row that are adjacent the bristles of the first row are arranged in an offset orientation to each other.

7. The brush element as claimed in claim 1 or claim 2, further comprising at least a first row pair comprising adjacent first and second rows and a second row pair comprising adjacent third and fourth rows, wherein the first row pair is adjacent the second row pair, and wherein the bristles of the first row pair relative to the bristles of the second row pair are arranged on the body so as to be inclined in opposite direction relative to the surface normal (38).

8. The brush element as claimed in claim 1 or claim 2, wherein the adjacent first and second rows are arranged on strips which are attached to the body by a wedging operation.

9. The brush element as claimed in claim 1 or claim 2, wherein each of the first row and second row comprises bristles formed as an integrally formed bristle strip.

10. The brush element as claimed in claim 1 or claim 2, wherein the body surface proximate to the bristles is of a concave configuration.

11. The brush element as claimed in claims 1 or 2, wherein apertures are provided in the body for receiving the bristles, and wherein adjacent apertures of each row, are at approximately right angles to each other.

12. The brush element as claimed in claim 1 or claim 2, wherein the adjacent first and second rows are arranged on strips which are attached to the body by a welding operation.

13. The brush element as claimed in claim 1 or claim 2, wherein the body surface proximate to the bristles is of a convex configuration.

14. The brush element as claimed in claim 1 or claim 2, wherein the body surface proximate to the bristles is of a planar configuration.

15. The brush element as claimed in claim 1 or claim 2, wherein the V-shaped bristle pairs (37) of the first row and the V-shaped bristle pairs (37) of the second row that are adjacent the V-shaped bristle pairs (37) of the first row are arranged on the body so as to be inclined in similar direction relative to the surface normal (38).

16. The brush element as claimed in claim 1 or claim 2, wherein the adjacent bristles of each said row forming the V-shaped bristle pairs (37) are separate.

17. The brush element of claim 1 for a heat-emitting hair care appliance.

18. The brush element of claim 17 in combination with the heat-emitting hair care appliance.

19. The brush element of claim 1 for an air-moving appliance.

20. The brush element of claim 19 in combination with the air-moving appliance.

* * * * *